US005749410A

United States Patent [19]

Uda et al.

[11] Patent Number: 5,749,410

[45] Date of Patent: May 12, 1998

[54] PROCESS FOR CASTING PIPE WITH TRANSVERSAL HOLE, AND CASTING DIE FOR THE SAME

[75] Inventors: Seiji Uda; Mitsuhiro Karaki, both of Okazaki; Shinichi Yoshida, Toyota; Hidehiko Kadono, Toyota; Atsushi Ota, Toyota; Hiroaki Mori, Toyota, all of Japan

[73] Assignee: Toyota Jidosha Kabushiki Kaisha, Aichi-ken, Japan

[21] Appl. No.: 743,211

[22] Filed: Nov. 5, 1996

Related U.S. Application Data

[63] Continuation-in-part of Ser. No. 357,184, Dec. 13, 1994, abandoned.

[30] Foreign Application Priority Data

| | | | |
|---|---|---|---|
| Dec. 15, 1993 | [JP] | Japan | 5-315271 |
| Dec. 24, 1993 | [JP] | Japan | 5-328326 |
| Nov. 21, 1994 | [JP] | Japan | 6-286562 |

[51] Int. Cl.[6] ..... B22D 17/10

[52] U.S. Cl. ..... 164/113; 164/137; 164/312

[58] Field of Search ..... 164/340, 369, 164/137, 133, 302, 351, 365, 366, 367, 368, 397, 398, 399, 400, 312, 113

[56] References Cited

FOREIGN PATENT DOCUMENTS

| | | | |
|---|---|---|---|
| 0 662 360 A1 | 7/1995 | European Pat. Off. . | |
| 2 637 322 | 4/1990 | France . | |
| 227704 | 3/1910 | Germany . | |
| 487802 | 12/1953 | Italy | 164/340 |
| A-59-189062 | 10/1984 | Japan . | |
| 61-9959 | 1/1986 | Japan . | |
| 1-314127 | 12/1989 | Japan . | |
| 4-118166 | 4/1992 | Japan . | |
| A-4-118166 | 4/1992 | Japan . | |

*Primary Examiner*—Kuang Y. Lin

*Attorney, Agent, or Firm*—Oliff & Berridge, PLC

[57] ABSTRACT

A process for casting a pipe such as a delivery pipe with transversal holes, the pipe having an elongate longitudinal hole and at least one pair of transversal holes communicating with the longitudinal hole in a substantially normal direction thereto. The process comprises the steps of positioning a rod-like center pin for forming the longitudinal hole in a predetermined positional relation to a cavity formation surface of a casting die, positioning a pair of mandrel pins for forming the pair of transversal holes such that end faces thereof are in contact with side surfaces of the center pin, and charging molten metal into a die cavity after the center pin and the pair of mandrel pins have been positioned. The molten metal is charged under the condition that the center pin is prevented from deforming by the pair of mandrel pins.

5 Claims, 9 Drawing Sheets

PROCESS FOR CASTING PIPE WITH TRANSVERSAL HOLE, AND CASTING DIE FOR THE SAME

This is a Continuation-in-Part of application Ser. No. 08/357,184, filed Dec. 13, 1994 now abandoned.

BACKGROUND OF THE INVENTION

1. Field of the Invention

FIG. 3 shows a delivery pipe for supplying fuel to an engine. The delivery pipe has an axially elongate longitudinal hole h and a plurality of transversal holes e1 to e4 communicating with the longitudinal hole h in a substantially normal direction thereto. The longitudinal hole is closed at a front end. Injectors are mounted in the transversal holes e1 to e4.

This invention relates to a process of casting a pipe with a transversal hole, i.e., a pipe having an elongate longitudinal hole and at least one transversal hole communicating with the longitudinal hole in a substantially normal direction thereto like the delivery pipe noted above, and a casting die used for the same casting process.

2. Description of the Prior Art

A casting process for casting a pipe having an elongate longitudinal hole is well known in the art. In such a process, a center pin for forming the longitudinal hole is positioned in a cavity before charging molten metal thereinto. The longitudinal hole is formed in the casting product by withdrawing the center pin therefrom after the solidification of the molten metal.

In this technique, increasing the length of the center pin gives rise to a problem of the displacement and deformation of the center pin during the casting process. The problem is pronounced in case where the center pin is positioned like a cantilever in the cavity, that is, where a casting product having a longitudinal hole closed at one end is cast. Furthermore, this problem becomes serious in die-casting where the molten metal is charged under high pressure. Techniques for preventing the displacement and deformation of the center pin have been proposed, as disclosed in Japanese Laid-open Patent Publication No. 59-189062 and Japanese Laid-open Patent Publication No. 61-9959. In both these techniques, a core pipe is used and is left in the casting product, so that the shape accuracy of the longitudinal hole is maintained.

FIG. 11 shows the technique disclosed in the Japanese Laid-open Patent Publication 59-189062. Designated at 6 is a core pipe which is positioned in a cavity 4. A pair of center pins 8*a* and 8*b* are inserted downward and upward into the core pipe 6. In this state, molten metal is charged into the cavity 4. With the solidification of the molten metal, the core pipe 6 is cast in the eventual casting product, i.e., the core pipe 6 is left in the casting product. Afterwards, the pair center pins 8*a* and 8*b* are withdrawn from the core pipe 6.

In the technique disclosed in the Japanese Laid-open Patent Publication No. 61-9959, only the core pipe is used, that is, no center pin is used. To position the core pipe in the cavity, the core pipe is provided with a projections projecting from its outer periphery. The projections are held in contact with a cavity formation surface. Afterwards, molten metal is charged into the cavity. With the solidification of the molten metal, the core pipe is cast in the casting product.

As shown above, by the use of a core pipe, it is possible to obtain a casting product having an elongate longitudinal hole. Particularly, according to the technique disclosed in the Japanese Laid-open Patent Publication 61-9959, it is possible to ensure a sufficiently long longitudinal hole closed at one end. When the core pipe is cast in the casting product, however, it is necessary to produce core pipes in number corresponding to the number of casting products, and this increases the cost of manufacture. Further, when it is desired to obtain a continuous integral casting product as overall produce, it is impossible to use any core pipe. When a process of forming a longitudinal hole without use of any core pipe but by using a center pin is adopted, on the other hand, there is the problem of center pin displacement and deformation, thus imposing restriction on the length of the obtainable longitudinal hole.

Italian 487,802 discloses a technique of adapting a center pin and a pair of mandrel pins. A pipe having a pair of transversal holes is cast by this technique. Japan 4-118166 discloses a technique in which a center pin is supported by a mandrel pin, and the deformation of the center pin by a high pressure of molten metal is prevented by the mandrel pin. By combining the techniques, it seems possible to prevent deformation of the center pin by the pair of mandrel pins during die-casting. However, there are many problems in the combination of these techniques.

SUMMARY OF THE INVENTION

The present invention seeks to solve the above problems by permitting the casting of a pipe having an elongate longitudinal hole without use of any core pipe.

With a pipe having an elongate longitudinal hole, it is often required to form one or more transversal holes communicating with the longitudinal hole. According to the invention, the displacement and deformation of the center pin is prevented by utilizing a mandrel pin for the formation of the transversal hole.

In one aspect of the invention, there is provided a process for casting a pipe with transversal holes, the pipe having an elongate longitudinal hole and at least one pair of transversal holes communicating with the longitudinal hole in a substantially normal direction thereto, which comprises the steps of positioning a rod-like center pin for forming the longitudinal hole in a predetermined positional relation to a cavity formation surface of a casting die, positioning a pair of mandrel pins for forming the pair of transversal holes such that end faces thereof are in contact with side surfaces of the center pin, and charging molten metal into a die cavity after the center pin and the pair of mandrel pins have been positioned. One of the mandrel pins is fixedly positioned with respect to a casing die, and other mandrel pin is biased towards the fixed mandrel pin.

According to the invention, a casting die for carrying out the above casting process is also provided. The casting die comprises a center pin disposed in a die cavity for forming the elongate longitudinal hole, and a pair of mandrel pins projecting into the die cavity in a substantially normal direction to the center pin for forming the pair of transversal holes, the position of the center pin being restricted in the radial direction thereof between end faces of the pair of mandrel pins when the casting die is closed. One of the mandrel pins is fixedly positioned with respect to the die and the other pin is biased towards the fixed pin.

With the above casting process and casting die, molten metal is charged and solidified with the center pin side surfaces positioned between the end faces of the pair of mandrel pins. It is thus possible to prevent the displacement and deformation of the center pin and ensure high shape accuracy of the longitudinal hole. In the above process, when the center pin is held in a cantilever support in the die cavity, the end of the center pin is suitably supported by the pair of mandrel pins. When the center pin is held in the cavity in its state of support at its opposite ends, its central portion is suitably supported by the pair of mandrel pins.

The above means, although very effective when casting a pipe having a pair of transversal holes, is difficult to carry out when the number of transversal holes is less than one pair. In such a case, the following means is used. That is, the end face of one mandrel pin is held in contact with a side surface of the center pin at least to prevent the center pin from being displaced toward that mandrel pin. This means alone, however, can not prevent the center pin from the displacement thereof away from the mandrel pin. Accordingly, in this process, molten metal is charged into the cavity toward the mandrel pin. When this is done so, the molten metal being charged pushes the center pin toward the mandrel pin and thus prevents the displacement thereof away from the mandrel pin. In this way, it is possible to cast a pipe having at least one transversal hole with satisfactory degree of shape accuracy. In this case, there is provided a clearance between the side face of the center pin and the end face of the mandrel pin before charging molten metal to the cavity.

According to the invention, this casting process is carried out with a casting die which comprises a center pin disposed in a die cavity for forming the elongate longitudinal hole, a mandrel pin projecting into the die cavity in a substantially normal direction to the center pin for forming the transversal hole, and a sprue for charging molten metal into the die cavity, an end face of the mandrel pin being nearly brought into contact with a side surface of the center pin when the casting die is closed, the sprue and the mandrel pin being located on the opposite sides of the center pin.

According to the invention, it is possible to obtain a casting product which is integral and a one-piece casting as a whole and in which the surfaces of the longitudinal hole and the transversal hole are cast skin surfaces. This casting product has satisfactory shape accuracy of the cast skin of the longitudinal hole, and it can be used as such. That is, there is no need of mechanically machining the cast skin to ensure accuracy, and thus, the product can be manufactured inexpensively.

The product can be suitably used as a delivery pipe. In this case, the longitudinal hole is used as a fuel path, and the transversal hole as an injector mounting hole. Such delivery pipes can be manufactured inexpensively in a large number by casting.

The present invention will be more fully understood from the following detailed description and appended claims when taken with the accompanying drawings.

DETAILED DESCRIPTION OF THE PREFERRED EMBODIMENTS

Now, a process for casting a pipe with transversal holes according to a first embodiment of the invention will be described with reference to FIGS. 1 to 6. In this embodiment, the pipe w with transversal holes to be cast is a delivery pipe with an injector mounted therein for supplying fuel to an engine. The pipe is shown in side view in FIG. 3.

The delivery pipe w has an axially elongate longitudinal hole h which extends in the axial direction and which is utilized as a fuel path, and has injector mounting transversal holes e1 to e4 communicating with the longitudinal hole h in a substantially normal direction thereto and formed at a uniform interval in the longitudinal direction. Further, the delivery pipe w has a pressure regulator mounting transversal hole p formed in its end portion and communicating with the longitudinal hole h in a substantially normal direction thereto and on the side opposite the injector mounting transversal hole e4.

Figure 1:
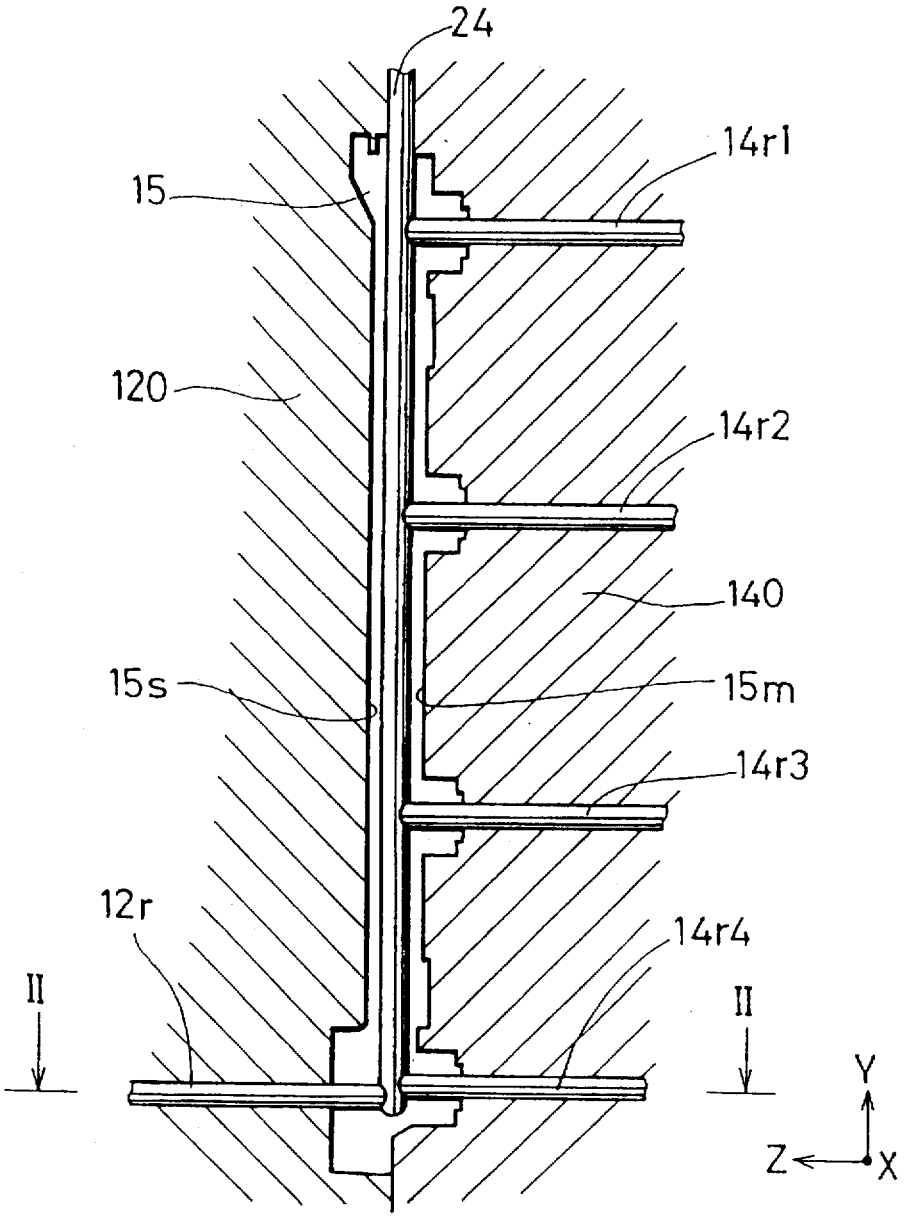
FIG. 1 is a fragmentary sectional view showing a casting die for carrying out a process of casting a pipe with transversal holes according to a first embodiment of the invention.
Figure 2:
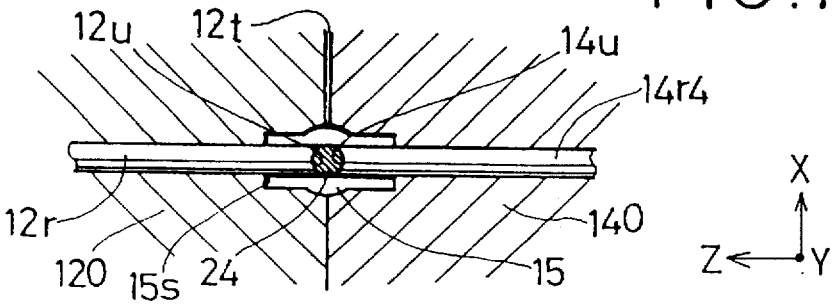
FIG. 2 is a fragmentary sectional view taken along arrow line II—II in FIG. 1.
Figure 3:
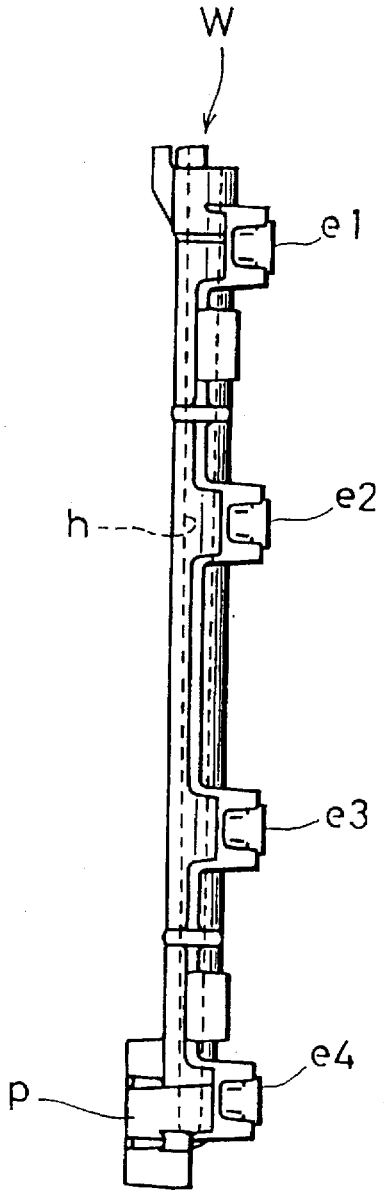
FIG. 3 is a side view showing a delivery pipe as a product of casting.
Figure 4:
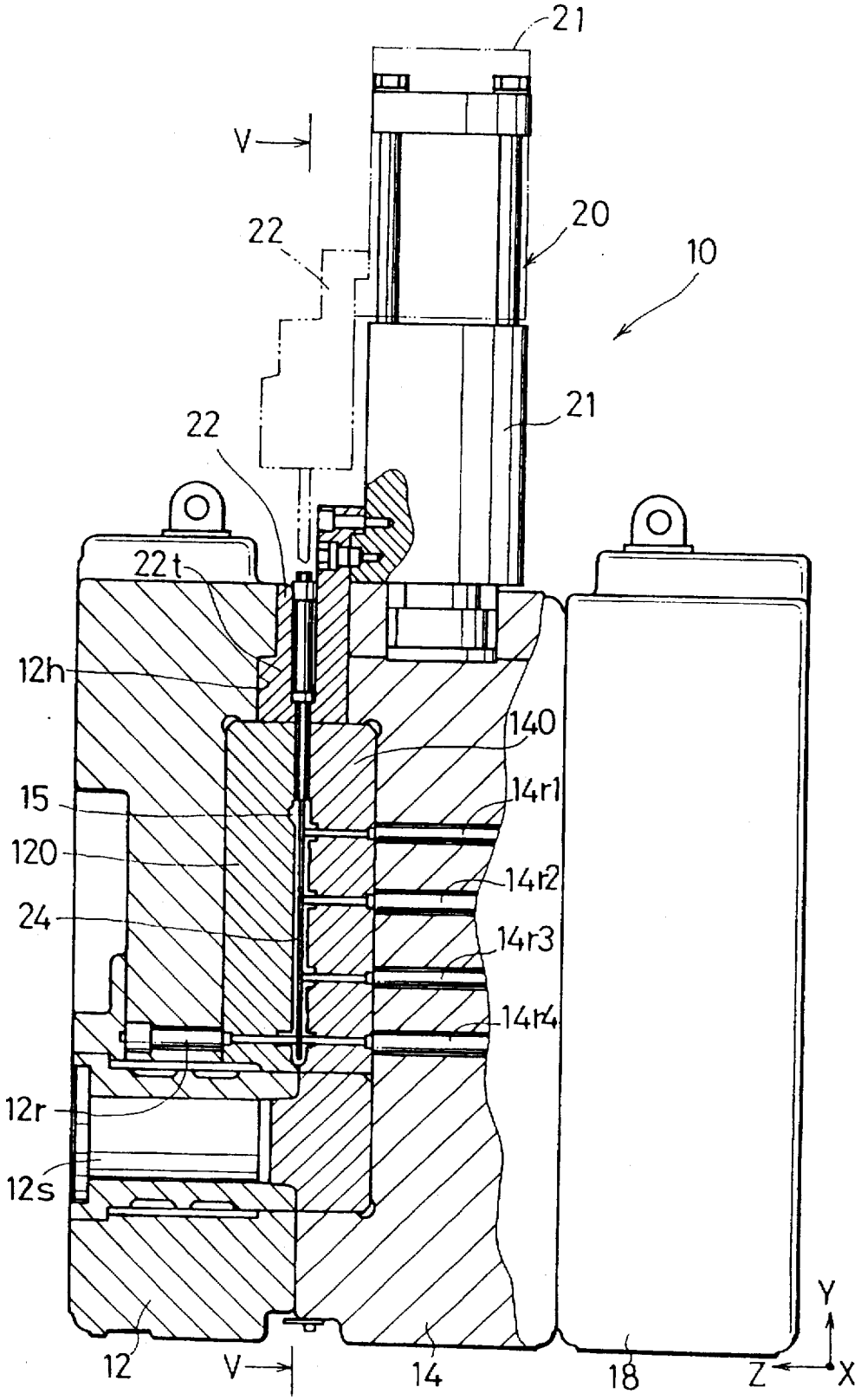
FIG. 4 is an elevational view, partly in section, showing the casting die for carrying out the process of casting a pipe with transversal holes according to the first embodiment of the invention.
Figure 5:
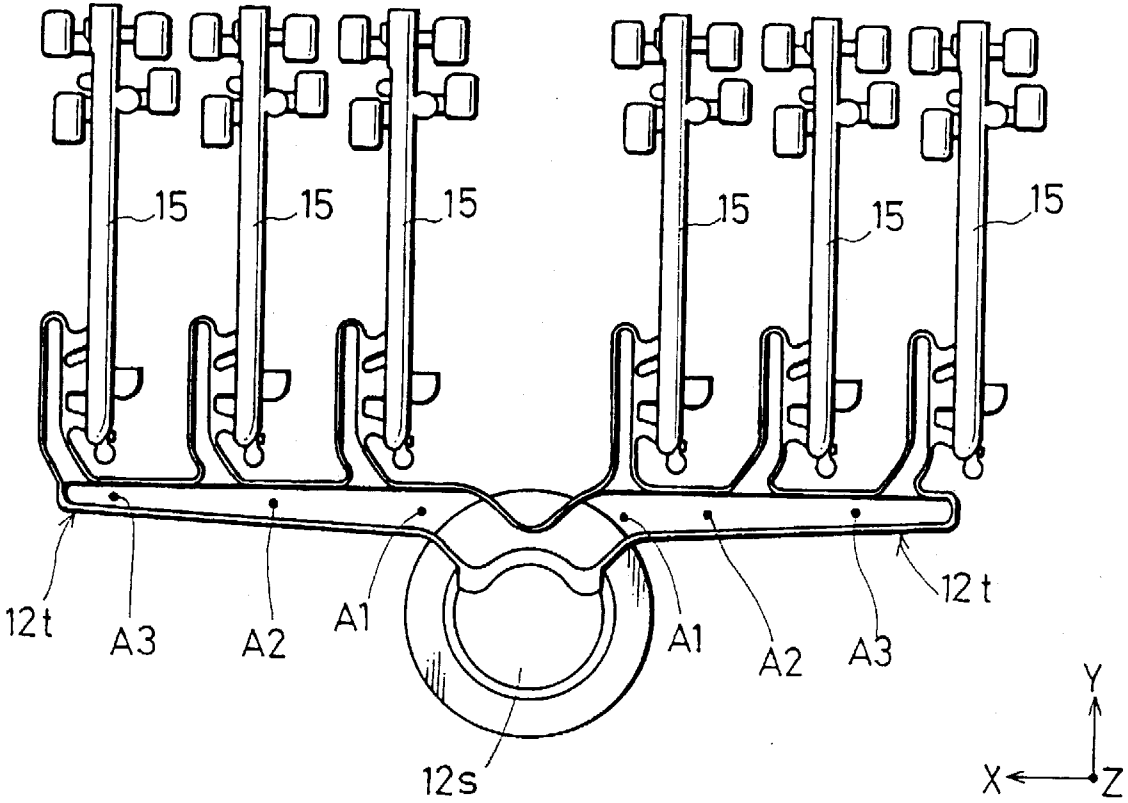
FIG. 5 is a view substantially taken along arrow line V—V in FIG. 4.

FIG. 4 is an elevational view, partly in section, showing a casting die 10 for forming the delivery pipe w by the casting process according to this embodiment. FIG. 1 is a view showing a part of FIG. 4 in detail. FIG. 2 is a view taken along arrow line II—II in FIG. 1. FIG. 5 is a view taken substantially along arrow line V—V in FIG. 4. In the following description, the die width direction is referred to as X-axis direction, the die height direction as Y-axis direction, and the die closing direction (i.e., direction of movement of a movable die) as Z-axis direction.

The casting die 10 comprises a fixed die 12 provided with a fixed insert member 120, and a movable die 14 provided with a movable insert member 140. As shown in FIG. 4, in the closed state of the casting die, product formation spaces, i.e., cavities 15, are formed elongatedly in the longitudinal direction (i.e., Y-axis direction) between the fixed insert member 120 and the movable insert member 140. In this embodiment, as shown in FIG. 5, six cavities 15 are formed in juxtaposition in the width direction of the casting die 10 (i.e., X-axis direction).

In a lower portion of the fixed die 12, a sleeve 12*s* is provided such that it extends in the Z-axis direction, and molten metal injected by a plunger tip (not shown) from the sleeve 12*s* is led through molten metal paths 12*t* (see FIG. 5) to be charged into the cavities 15. The sectional area of the molten metal paths 12*t* is set such that it is reduced as one goes away from the sleeve 12*s*, that is, such that sectional area Al sectional area A2 sectional area A3. With this arrangement, the charging rate of the cavity 15 at the end on the side of the vehement charging with the momentum of molten metal is suppressed to a certain extent, thus substantially uniforming the charging time of the individual cavities 15.

In the fixed die 12, a mandrel pin 12*r* for forming the pressure regulator mounting transversal hole p in the delivery pipe w is mounted for each cavity 15. The mandrel pin 12*r* is positioned such that its axis is parallel to the Z-axis. As shown in FIGS. 1 and 2, its end face projects by a prescribed dimension from a cavity formation surface 15*s* of the fixed insert member 120. Further, its end face is formed with an arcuate recess 12*u* such as to be substantially in close contact with a side surface of a center pin 24 to be described later.

The movable die 14 is coupled via a die base 18 to a drive unit (not shown), and with the driving thereof, it is moved in the Z-axis direction from a position to close the die to a position to open the die or vice versa. To the top of the movable die 14 is secured a center pin insertion cylinder 20 for moving a movable unit 21 in the Y-axis direction (i.e., vertical direction). On the movable unit 21 of the center pin insertion cylinder 20 is mounted a support block 22 supporting center pins 24. Each center pin 24 is a mandrel pin for forming the longitudinal hole h in the delivery pipe w, and is mounted in the support block 22 for movement in the vertical direction along the center line of each cavity 15. The support block 22 has a raised portion 22*t* which is engaged in a recessed portion 12*h* of the fixed die 12 when the casting die is closed, thus preventing the support block 22 from being pushed back upward by high pressure applied to the interior of the cavities 15.

The movable die 14 is provided with two sets of center pin insertion cylinder 20 and support block 22. Three center pins 24 are raised and lowered simultaneously by one set of center pin insertion cylinder 20 and so forth.

As shown in FIGS. 1 and 4, in the movable die 14, four movable mandrel pins 14*r*1 to 14*r*4 for forming the injector mounting transversal holes e1 to e4 in the delivery pipe w, are provided for each cavity 15. The movable mandrel pins 14*r*1 to 14*r*4 are movable at right angles to the center pin 24 (i.e., Z-axis direction) and are moved axially by drive cylinders (not shown). The drive cylinders have enough power to keep positions of the mandrel pins 14*r*1 to 14*r*4 at predetermined positions against the pressure at which molten metal is charged into the cavity. Their end faces are each formed with an arcuate recess 14*u* to be substantially in close contact with a side surface of the center pin 24.

The movable mandrel pins 14*r*1 to 14*r*4 , the fixed mandrel pins 12*r* and the center pins 24 all have their surfaces provided with TD treatment, P-CVT treatment, etc. for the seizure prevention purpose.

Figure 6:
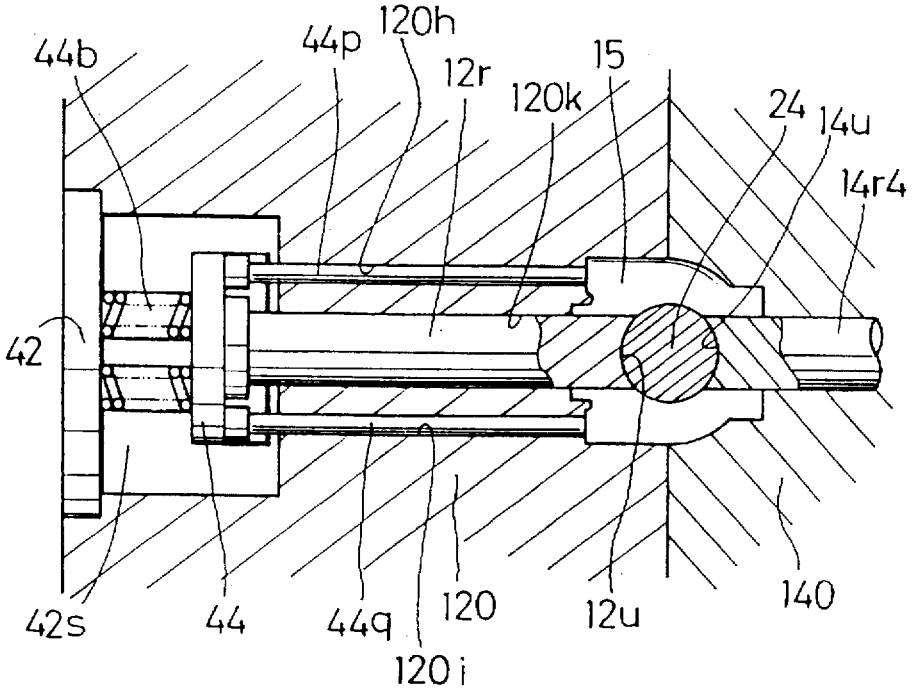
FIG. 6 is a fragmentary sectional view, partly broken away, showing a mandrel pin and push-out pins in detail.

FIG. 6 shows the detailed structure of the mandrel pin 12*r* on the side of the fixed insert member 120. The fixed insert member 120 has a space 42*s* in which is accommodated a push-out member 44 having a pair of push-out pins 44*p* and 44*q* and a mandrel pin 12*r*.

The mandrel pin 12*r* is mounted on the center of the push-out member 44 such that it extends at right angles thereto, and the pair push-out pins 44*p* and 44*q* are provided in right angles around the mandrel pin 12*r*. The mandrel pin 12*r* and the push-out pins 44*p* and 44*q* are inserted in through holes 120*k*, 120*h* and 120*i* for axial movement through the same in a horizontal state. The space 42*s* is closed by a retainer member 42, and a spring member 44*b* biasing the push-out member 44 away from the retainer member 42 is mounted between the retainer member 42 and the push-out member 44. Thus, in the open state of the casting die, the push-out member 44 pushed by the spring force of the spring member 44*b* is held at a right set position in FIG. 6. In this state, the projection of the mandrel pin 12*r* and the push-out pins 44*p* and 44*q* from the fixed insert member 120 is maximum. The lengths of the push-out pins 44*p* and 44*q* and the mandrel pin 12*r* are set such that when the die closing is completed, the ends of the push-out pins 44*p* and 44*q* are substantially in accord with the position of the surface of each cavity 15 with the recessed end 12*u* of the mandrel pin 12*r* in contact with a side surface of the center pin 24.

Now, the process of casting a pipe (or delivery pipe w) with transversal holes according to this embodiment will be described.

First, in the open state of the casting die, the movable unit 21 is lowered with the operation of the center pin insertion cylinder 20 of the movable die 14. As a result, the center pin 24 is lowered along a center line of each cavity 15 to be positioned at a predetermined position. Then, each of the movable mandrel pins 14*r*1 to 14*r*4 is moved by a drive cylinder to be projected by a prescribed dimension from each cavity formation surface 15*m* of the movable insert member 140. With the movable mandrel pins 14*r*1 to 14*r*4 projected from each cavity formation surface 15*m* of the movable insert member 140, a clearance of about 0.3 mm is provided between the end recess 14*u* of each of the movable mandrel pins 14*r*1 to 14*r*4 and a side surface of each center pin 24. The end face 14*u* of each of the mandrel pins 14*r*1 to 14*r*4 and the side surface of each center pin 24 need not be in perfectly close contact with each other, but they face each other with a slight clearance therebetween.

Then, the casting die is closed with the movable die 14 and the die base 18 moved by the drive unit, as shown in FIGS. 1 and 4. Thus, the cavities 15 are formed between the fixed insert member 120 and the movable insert member 140. Further, the side surface of each center pin 24 is brought into contact with the recessed end 12*u* of the mandrel pin 12*r* to contract the spring member 44*b* and cause retreat of the mandrel pin 12*r*. At this time, the push-out pins 44*p* and 44*q* are also retreated to be flush with the cavity formation surface. When the closing of the casting die is completed in this way, the center pin 24 is slightly bent towards the mandrel pins 14*r*1 to 14*r*4 by the mandrel pins 12*r*, and the clearance between the front face of the mandrel pins 14*r*1 to 14*r*4 and the side face of the center pin 24 becomes zero. That is, the center pin is fixedly positioned by the mandrel pins. The center pin 24 is rigid but it can be bent slightly by elasticity. Then, molten metal injected from the sleeve 12*s* through the plunger tip is charged into each cavity 15 through each molten metal path 12*t*. When the molten metal is solidified after the lapse of a predetermined period of time, the casting die is opened again with the movable die 14 and the die base 18 moved by the drive unit. Further, each center pin 24 is taken out with the driving of each center pin insertion cylinder 20, and each of the movable mandrel pins 14*r*1 to 14*z*4 is taken out by the drive cylinder.

Since the sectional areas A1 to A3 of the molten metal paths 12*t* are set such as above to provide for a substantially uniform molten metal charging time for each cavity 15, the molten metal solidification time does not fluctuate for each cavity 15, and it is possible to set die opening timings satisfactorily.

With the movable die 14 separated from the fixed die 12 when the casting die is opened after the casting, the pushing force from the center pin 24 is no longer applied to the end of the mandrel pin 12*r*, and the push-out member 44 is moved away from the retainer member 42 by the spring force of the spring member 44*b*. As a result, the push-out pins 44*p* and 44*q* project from the cavity formation surface of the fixed die 12. Thus, the product of casting is kicked out from the surface of the cavity 15.

As shown above, according to the process for casting the delivery pipe w of this embodiment, in the closed state of the casting die 10, the end of the center pin 24 which is readily subject to displacement, is restricted radially by the recessed end 14*u* of the movable mandrel pin 14*r*4 and the recessed end 12*u* of the fixed mandrel pin 12*r*. Thus, with application of a high pressure to the center pin 24 as a result of forced charging of molten metal into the cavity 15, the end of the center pin 24 is not displaced radially, thus substantially eliminating the bending of the center pin 24 during the casting. It is thus possible to eliminate such inconvenience as failure of withdrawal of the center pin 24 after the solidification of molten metal. This means that, unlike the prior art, there is no need of providing any particular core pipe or the like for the reinforcement of the center pin 24. Further, since a clearance of about 0.3 mm is provided between the side surface of the center pin 24 and the recessed end 14*u* of the movable mandrel pin 14*r*4 , it is possible to absorb error concerning to the shapes and the error concerning to the positions of the pins 14*r*4 and 24. Furthermore, the mandrel pin 12*r* is biased towards the mandrel pin 14*r*4 , then it is possible to surround the side face of the center pin 24 in a vicinity of the free end by the front faces of the mandrel pins 14*r*4 and 12*r*, in spite of the error as described above and thermal expansion of the center pin 24 and the mandrel pins 14*r*4 and 12*r* that is caused during the casting.

In the casting die of this embodiment, the mandrel pin 12*r* also serves the role of a return pin for causing the retreat of the push-out pins 44*p* and 44*q* to the cavity formation surface.

Figure 12A:
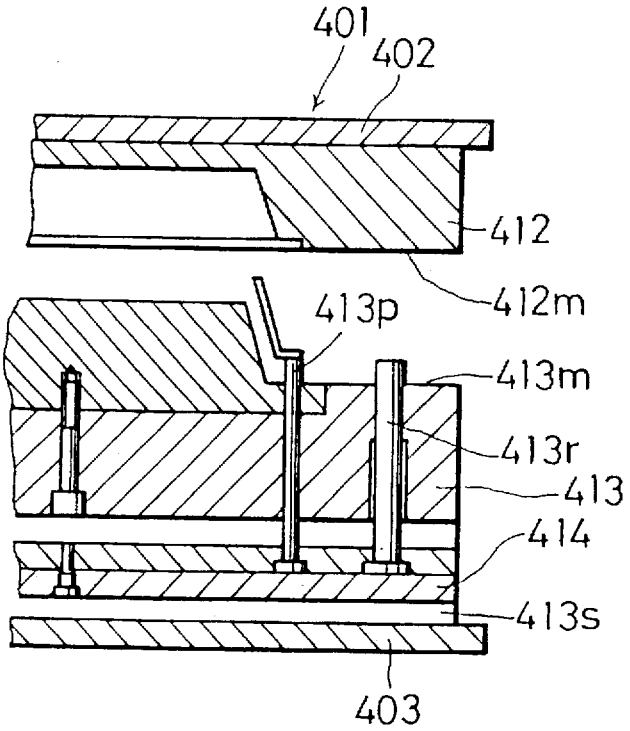
FIG.12(A) PRIOR ART
FIGS. 12(A) and 12(B) are fragmentary sectional views showing a relation between a return pin and a push-out pin in the prior art.
Figure 12B:
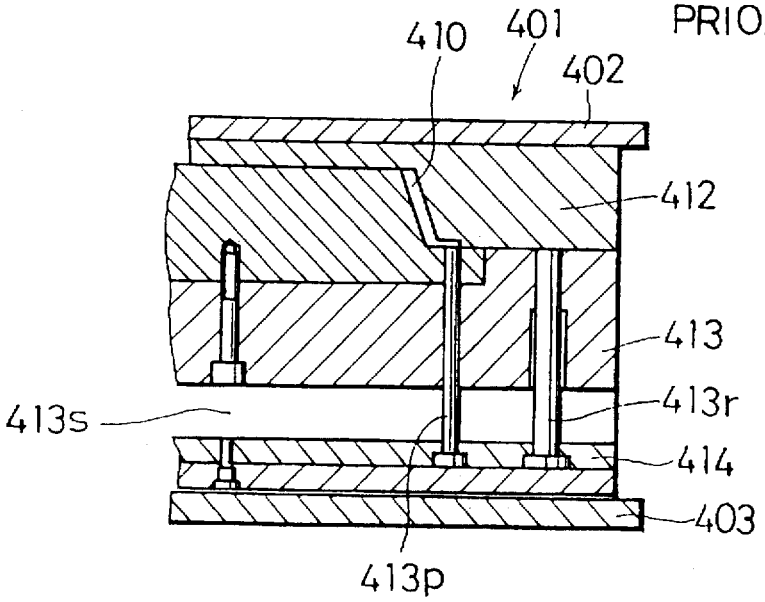
FIG.12(B) PRIOR ART

FIGS. 12(A) and 12(B) show a prior art relationship between a push-out pin and a return pin as disclosed in Japanese Laid-open Patent Publication No. 1-314127.

This casting die 401 comprises a fixed die 412 mounted on a fixed die mounting member 402 and a movable die 413 mounted on a movable die mounting member 403. As shown in FIG. 12(B), in the closed state of the casting die 401, a cavity 410 is formed therein. Further, the movable die 413 has a space 413*s* in which a push-out member 414 is accommodated for movement in the vertical direction in FIG. 12(B). The push-out member 414 has a push-out pin 413*p* for kicking out a casting product from the surface of the cavity 410 at the time of the die opening and a return pin 413*r* for returning the end of the push-out pin 413*p* to the position of the surface of the cavity 410 at the time of the die closing. A spring member (not shown) is provided between the push-out member 414 and the movable die mounting member 403, and the push-out member 414 is biased upward by the spring force. Thus, when the casting die 401 is open, the push-out pin 413*p* is projecting from the surface of the cavity 410 (movable die 413), while the return pin 413*r* is projecting from the engagement surface 413*m* of the movable die 413.

With the above construction, when the end of the return pin 413*r* is brought into contact with the engagement surface 412*m* of the fixed die 412 during the process of approach of the fixed die 412 by the movable die 413 at the time of the die closing, the return pin 413*r* is pushed into the movable die 413 to an extent corresponding to the distance of approach of the fixed die 412 by the movable die 413. Thus, the push-out member 414 is moved downward in FIG. 12(B) against the spring force. At this time, in the perfectly closed state of the casting die 401, the push-out pin 413*p* is returned to a position such that its end is substantially in accord with the surface of the cavity 410.

With the movable die 413 separated from the fixed die 412 when the casting die is opened after the casting, the push-out force from the fixed die 412 is no longer applied to the return pin 413*r*. As a result, the push-out member 414 is moved upward in FIG. 12(A) by the spring force, and the push-out pin 413*p* projects from the surface of the cavity 410 of the movable die 413. Thus, the product of casting is kicked out from the surface of the cavity 410, that is, prevented from remaining on the cavity surface.

With the above prior art casting die 401, however, the return pin 413*r* for returning the push-out pin 413*p* to a predetermined position is provided at the position of the engagement surface 413*m* of the movable die 413. This means that in the casting die 401, it is necessary to set the width of the engagement surface 413*m* constituting the periphery of the cavity 410 by taking the space for mounting the return pin 413*r* into consideration. In addition, it is necessary to set the area of the push-out member 414 supporting the push-out pin 413*p* and the return pin 413*r* to be greater than the area of projection of the cavity 410. Therefore, a large space is necessary in the casting die 410, thus increasing the size of the casting die 401 and also dictating restrictions in the die design.

In contrast, with the construction shown in FIG. 6, the mandrel pin 12*r* also serves the role of the prior art return pin 413*r*, and thus the outer shape dimensions of the die are extremely reduced. In addition, while in the prior art, a clearance has to be provided between the center pin 24 and the mandrel pin 12*r* by taking the thermal expansion of the two pins into consideration, in this embodiment, no such clearance has to be provided because the mandrel pin 12*r* is capable of being retreated.

A second embodiment of the invention will be described with reference to FIGS. 7 and 8.

Figure 7:
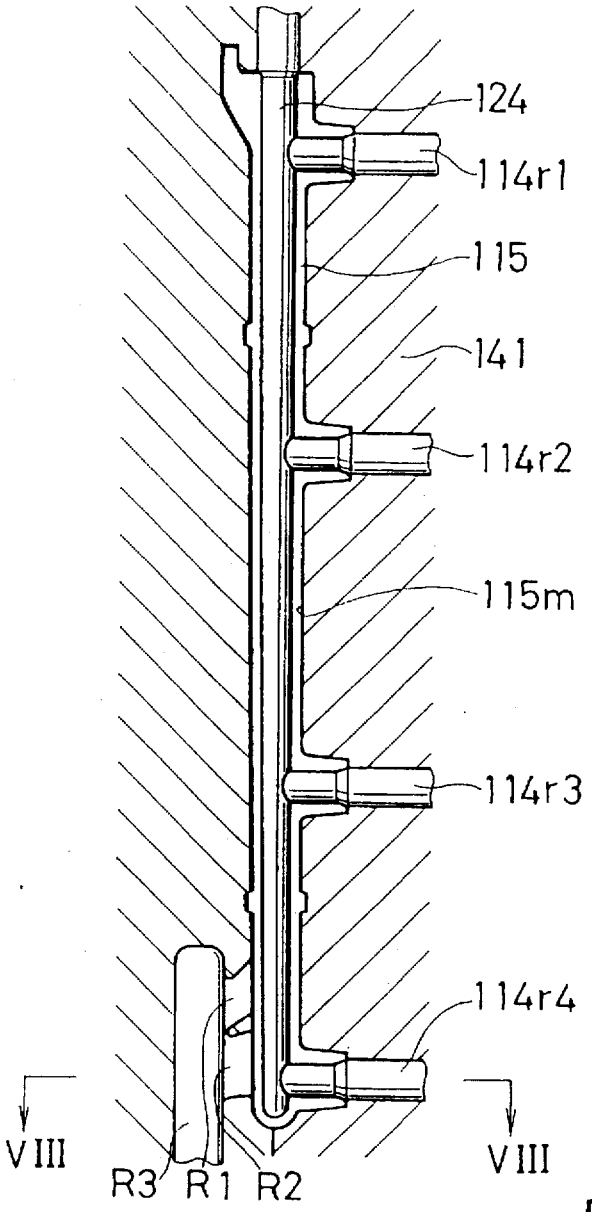
FIG. 7 is a view similar to FIG. 1 but showing a second embodiment of the invention.
Figure 8:
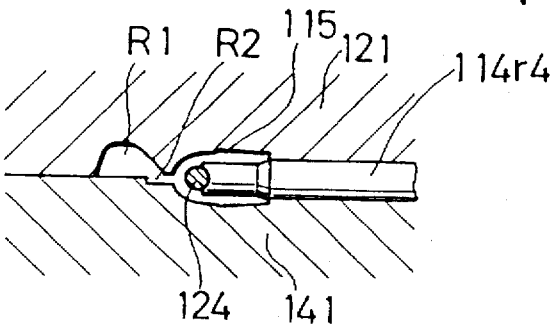
FIG. 8 is a view similar to FIG. 2 but showing the second embodiment.

FIG. 7 is a view similar to FIG. 1, and FIG. 8 is a sectional view taken along line VIII—VIII in FIG. 7. Parts like those in the first embodiment are designated by like reference numerals with addition of 100, and their detailed description will be omitted.

What is produced in this embodiment is the delivery pipe w described before in connection with FIG. 3 with omission of the pressure regulator mounting transversal hole p. Without the pressure regulator mounting transversal hole p, the center pin 24 can not be restricted from the opposite sides with a mandrel pin. In the case of this embodiment, a center pin 124 is supported from a single side by a single mandrel pin 114*r*4 , as is obvious from FIGS. 7 and 8.

In this case, the center pin 24 may be displaced away from the mandrel pin 114*r*4. Accordingly, in this embodiment, a sprue R2 through which to charge molten metal into the cavity 115 is provided at an angle with respect to a position to charge molten metal toward the mandrel pin 114*r*4. With this arrangement, the charging pressure acts in a direction of pushing the center pin 124 against the mandrel pin 114*r*4 , and thus, there is no possibility of displacement of the center pin 124 away from the mandrel pin 114*r*4. Molten metal is further charged from a sprue R3 through a sprue R1 into the cavity 115, and this charging pressure again acts on the side of pushing the center pin 124 against the mandrel pin 114*r*4.

When the center pin 124 and mandrel pins 114r1 o 114r4 are positioned for casting, there is provided a clearance of about 0.3 mm between the side face of the center pin 24 and the front face 114U of the mandrel pins 114r1 to 114r4. When molten metal is charged into the cavity, the center pin 124 is elastically deformed and the clearance is closed.

Figure 9:
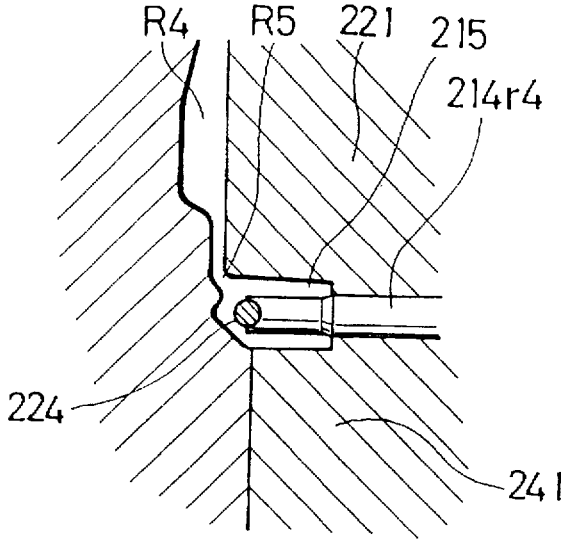
FIG. 9 is a view similar to FIG. 8 but showing a third embodiment of the invention.

FIG. 9 shows a third embodiment. Again in this case, a sprue R5 and a mandrel pin 214r4 may not always face each other. In any case, molten metal being charged flows toward the side of pushing a center pin 224 against the mandrel pin 214r4. Thus, the center pin 224 is not displaced or deformed.

Figure 10:
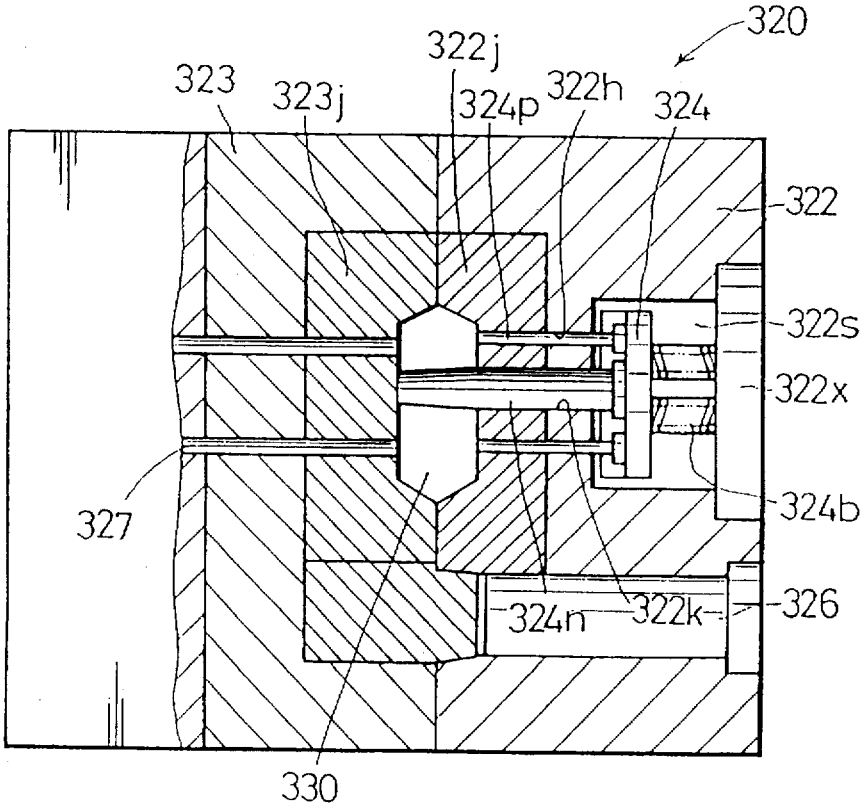
FIG. 10 is a view showing a different example of the relation between a mandrel pin and push-out pins from that shown in FIG. 6.
Figure 11:
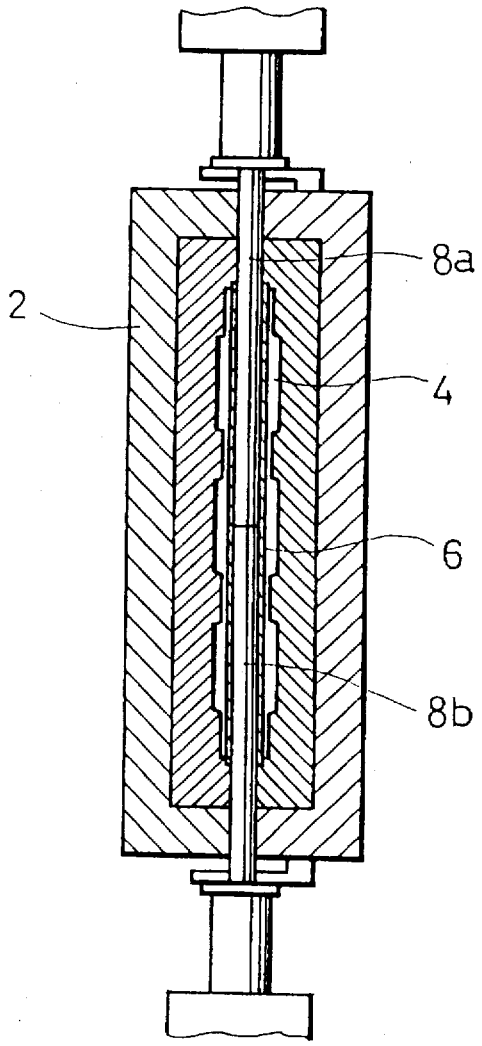
FIG.11 PRIOR ART
FIG. 11 is a fragmentary sectional view showing a casting die for carrying out a prior art pipe casting process.

FIG. 10 shows a different example of the relation between a mandrel pin and push-out pins.

In this embodiment, a casting die 320 comprises a fixed die 322 with a fixed insert member 322j mounted therein and a movable die 323 with a movable insert member 323j mounted therein. As shown in FIG. 10, a cavity 330 is formed in the die 320 when the die is closed. Then, molten metal forced out from a sleeve 326 provided in the fixed die 322 is charged through a molten metal path (not shown) into the cavity 330.

The fixed die 322 has a space 322s which is formed in the neighborhood of the back side of the fixed insert member 322j, and inn the s pace 322s is accommodated a push-out member 324 with a push-out pin 324p and a mandrel pin 324n. The push-out pin 324p serves to push out a casting product from the fixed insert member 322j after the casting, and the mandrel pin 324n is used to form a through hole in the product.

The push-out member 324 has a mandrel pin 324n extending from and at right angles to its center and also has a plurality of push-out pin s 324p which are likewise mounted by right angle mounting around the mandrel pin 324n. The mandrel pin 324n and the push-out pin 324p are inserted in through holes 322h and 322k of the fixed die 322 and the fixed insert member 322j, so that the mandrel pin 324n and the push-out pin 324p can be moved axially in their horizontal position. The space 322s is closed by a retainer member 322x. A spring member 324b biasing the push-out member 324 away from the retainer member 322x is provided between the retainer member 322x and the push-out member 324. Thus, in the closed state of the casting die, the push-out member 324 is held at a left set position in FIG. 10 by the spring force of the spring member 324b. Thus, the mandrel pin 324n and the push-out pin 324p are in maximum projection from the fixed insert member 322j. The length of the mandrel pin 324n is set to be greater than the length of the push-out pin 324p by an amount corresponding to the thickness of the cavity 330

Further, a push-out pin 327 for kicking out a casting product from the movable insert member 323j after the casting, is mounted horizontally in the movable die 323 and movable insert member 323j. Further, in the movable die 323 is accommodated a push-out cylinder (not shown) for axially moving the push-out pin 327.

Now, the operation of the casting die 320 will be described. First, during the approach of the movable die 323 toward the fixed die 322 when the casting die is closed, the mandrel pin 324n is brought into contact with the cavity surface of the movable insert member 323j. As this occurs, the movable insert member 323j pushes the mandrel pin 324n in the axial direction. As a result, the mandrel pin 324n is forced into the fixed insert member 322j and the fixed die 322 by the distance corresponding to the approach of the movable die 323 toward the fixed die 322, so that the push-out member 324 is moved toward the retainer member 322x against the spring force of the spring member 324b. Then, as the push-out member 324 is moved, the push-out pin 324p is received in the fixed insert member 322j. Since the length of the mandrel pin 324n is set to be greater than the length of the push-out pin 324p by an amount corresponding to the thickness of the cavity 330 as noted above, when the die 320 is completely closed, the push-out pin 324p is retreated into the fixed insert member 322j until its end is substantially in accord with the cavity surface of the fixed insert member 322j.

Subsequently, molten metal is forced through the sleeve 326 and molten metal path (not shown) into the cavity 330 for casting. With the movable die 323 separated from the fixed die 322 when the casting die is opened after the casting, the pushing force from the movable insert member 323j is no longer applied to the end of the mandrel pin 324n, and the push-out member 324 is thus moved away from the retainer member 322x by the spring force of the spring member 324b. As a result, the push-out pin 324p is projected from the surface of the cavity wall of the fixed insert member 322j to kick out the casting product from the surface of the cavity 330, that is, prevent the product from remaining on the cavity wall. Further, in the movable die 323 the push-out pin 327 is operated by a push-out cylinder (not shown) for separating the casting product from the surface of the cavity 330.

As shown above, with the casting die 320 of this embodiment, the mandrel pin 324n mounted on the push-out member 324 with the push-out pin 324p secured thereto, also serves as a return pin. Thus, unlike the prior art, there is no need of disposing any return pin at the position of the engagement surface of the cavity 330, thus permitting the reduction of the width of the engagement surface. Further, since the mandrel pin 324n is disposed at a position to penetrate the cavity 330, the area of the push- out member 324 supporting the mandrel pin 324n and the push-out pin 324p may be made smaller than the area of projection of the cavity 30. Thus, the die may have a reduced space for accommodation of the push-out member 324, thus permitting the die 320 to be made compact.

According to the invention, molten metal is charged in a state such that the center pin for forming a longitudinal hole in a pipe is restricted by the end face of the mandrel pin for forming a transversal hole in the pipe. Thus, application of a high molten metal pressure to the center pin during the casting does not cause displacement or deformation of the center pin in the radial direction, and it is possible to substantially eliminate the bending of the center pin. This eliminates the possibility of such inconvenience as failure of withdrawal of the center pin. Further, since unlike the prior art, no core pipe or the like is required, the cost of manufacture can be reduced.

Further, according to the invention, since the mandrel pin also has a role of a return pin for returning the push- out pin, there is no need of disposing any return pin at the position of the engagement surface of the cavity. Further, the area of the push-out member supporting the mandrel pin and the push-out pin may be made smaller than the area of projection of the cavity, thus permitting the reduction of the push-out member accommodation space in the die. The casting die thus may be made compact.

While the invention has been described with reference to preferred embodiments thereof, it is to be understood that modifications or variations may be easily made without departing from the scope of the present invention which is defined by the appended claims.

What is claimed is:

1. A process for die-casting a pipe, the pipe having an elongate longitudinal hole and a transversal hole, the elongate longitudinal hole being closed at a front end and the transversal hole communicating with the longitudinal hole in a substantially normal direction thereto at a vicinity of the closed end, the process comprising the steps of:

positioning a mandrel pin having a front face at a front end for forming the transversal hole by fixing the mandrel pin with respect to a casting die;

positioning a rod like center pin having a free end at a front end for forming the longitudinal hole by fixing the center pin with respect to the casting die; a side face of the center pin in the vicinity of the free end and the front face of the mandrel pin being nearly in contact with a fine clearance between the faces; and charging high pressure molten metal toward the center pin into a die cavity after the center pin and the mandrel pin have been positioned with respect to the casting die to cause the center pin to elastically bend towards the mandrel pin so that the side face of the center pin in the vicinity of the free end is in contact with the front face of the mandrel pin; and drawing out the center pin and the mandrel pin from a cast product.

2. The process according to claim 1, wherein the molten metal is charged into the die cavity towards the mandrel pin so that the center pin is elastically bent towards the mandrel pin.

3. A process for die-casting a pipe, the pipe having an elongate longitudinal hole and a pair of transversal holes, the elongate longitudinal hole being closed at a front end and the pair of transversal holes communicating with the longitudinal hole in a substantially normal direction thereto from opposite sides at a vicinity of the closed end, the process comprising the steps of:

positioning a first mandrel pin having a front face at a front end for forming one of the transversal holes by fixing the first mandrel pin with respect to a casting die;

positioning a rod like center pin having a free end at a front end for forming the longitudinal hole by fixing the center pin with respect to the casting die, a side face of the center pin in the vicinity of the free end and the front face of the first mandrel pin being nearly in contact with a fine clearance between the faces;

positioning a second mandrel pin having a front face at a front end for forming the other of the transversal holes with respect to the casting die, the second mandrel pin being biased towards the first mandrel pin so that the center pin is bent towards the first mandrel pin until the side face of the center pin in the vicinity of the free end is in contact with the front face of the first mandrel pin;

charging high pressure molten metal into a die cavity after the center pin and the pair of mandrel pins have been positioned with respect to the casting die under the condition that the side face of the center pin in the vicinity of the free end is surrounded by the front faces of the pair of the mandrel pins; and drawing out the center pin and the pair of the mandrel pins from a cast product.

4. A casting die for die-casting a pipe, the pipe having an elongate longitudinal hole and a pair of transversal holes, the elongate longitudinal hole being closed at a front end and the pair of transversal holes communicating with the longitudinal hole in a substantially normal direction thereto from opposite sides at a vicinity of the closed end, the die comprising:

a casting die defining a cavity for forming a cast product;

a first mandrel pin having a front face at a front end for forming one of the transversal holes, the first mandrel pin being fixedly positioned with respect to the casting die;

a rod like center pin having a free end at a front end for forming the longitudinal hole, the center pin being fixedly positioned with respect to the casting die, a side face of the center pin in the vicinity of the free end and the front face of the first mandrel pin being nearly in contact with a fine clearance between the faces;

a second mandrel pin having a front face at a front end for forming the other of the transversal holes, the second mandrel pin being biased towards the first mandrel pin with respect to the casting die so that the center pin is elastically bent towards the first mandrel pin until the side face of the center pin in the vicinity of the free end is in contact with the front face of the first mandrel pin when the casting die is closed;

whereby high pressure molten metal is charged into the cavity in the condition that a side face of the center pin in the vicinity of the free end is surrounded by the front faces of the pair of the mandrel pins.

5. A casting die for die-casting a pipe, the pipe having an elongate longitudinal hole and a transversal hole, the elongate longitudinal hole being closed at a front end and the transversal hole communicating with the longitudinal hole in a substantially normal direction thereto at a vicinity of the closed end, the die comprising a casting die defining a cavity for forming a cast product and a sprue for charging molten metal into the cavity;

a mandrel pin having a front face at a front end for forming the transversal hole, the mandrel pin being fixedly positioned with respect to the casting die;

a rod like center pin having a free end at a front end for forming the longitudinal hole, the center pin being fixedly positioned with respect to the casting die, a side face of the center pin in the vicinity of the free end and the front face of the mandrel pin being nearly in contact with a fine clearance between the faces, wherein the sprue and the mandrel pin are located in the opposite sides of the center pin so that the center pin is elastically bent until a side face of the center pin in the vicinity of the free end is in contact with the front face of the mandrel pin when high pressure molten metal is charged into the cavity.

* * * * *